US005535611A

United States Patent [19]

Lilie

[11] Patent Number: 5,535,611

[45] Date of Patent: Jul. 16, 1996

[54] PROCESS FOR THE PERMANENT BENDING OF DEFORMABLE BODIES

[75] Inventor: Dietmar E. B. Lilie, Joinville, Brazil

[73] Assignee: Empresa Brasileira de Compressores S/A - Embraco, Joinville, Brazil

[21] Appl. No.: 353,846

[22] Filed: Nov. 11, 1994

Related U.S. Application Data

[63] Continuation-in-part of Ser. No. 937,576, Aug. 28, 1992, abandoned.

[30] Foreign Application Priority Data

Aug. 30, 1991 [BR] Brazil ..... 9103814

[51] Int. Cl.[6] ..... B21D 07/14

[52] U.S. Cl. ..... 72/17.3; 72/15.3; 72/702

[58] Field of Search ..... 72/14.8, 15.2, 72/15.3, 31.1, 31.11, 31.12, 30.1, 17.3, 702

[56] References Cited

U.S. PATENT DOCUMENTS

| | | | |
|---|---|---|---|
| 3,352,136 | 11/1967 | Clarke | 72/702 |
| 3,459,018 | 8/1969 | Miller | 72/702 |
| 4,078,407 | 3/1978 | Ditges | 72/702 |
| 4,627,255 | 12/1986 | Archer et al. | 72/17.3 |

FOREIGN PATENT DOCUMENTS

| | | | |
|---|---|---|---|
| 2601603 | 1/1988 | France | 72/702 |
| 96326 | 5/1985 | Japan | 72/702 |
| 232018 | 10/1986 | Japan | 72/702 |

*Primary Examiner*—Lowell A. Larson
*Attorney, Agent, or Firm*—Darby & Darby

[57] ABSTRACT

A method of permanently bending a first part of a subject body having non-linear elastic properties about a bending line to a desired angle relative to a second part of the body in which a first set of data is produced from similar bodies of the amount of permanent bending obtained as a function of different amounts of angular displacement of the first part, the first part of a subject body is permanently bent to a first angle different from said desired angle by angularly displacing the subject body's first part by an amount determined by the first set of data and thereafter the first part of the subject body is further angularly displaced from the first angle to permanently bend its first part to the desired angle.

10 Claims, 3 Drawing Sheets

PROCESS FOR THE PERMANENT BENDING OF DEFORMABLE BODIES

RELATED APPLICATION

This application is a continuation-in-part of application Ser. No. 07/937,576, filed Aug. 28, 1992, now abandoned.

FIELD OF THE INVENTION

The present invention refers to a process for the automatic bending of different bodies, such as generally metallic rods or blades, in order to achieve a precise plastic or permanent deformation thereof, independently of certain microstructure, molecular composition and/or dimension deviations from respective nominal values which were predetermined for these bodies.

BACKGROUND OF THE INVENTION

The automatic bending of bodies, which are generally in the form of elongated rods or blades, has been achieved through an operation in which the body, which is usually fastened at an end portion of its longitudinal extension, has its free end portion submitted to only one bending through an angular displacement in the direction of the desired plastic deformation to be achieved, said displacement being carried out in a single plastic deformation operation, by applying a force to the free portion of the body that is going to be bent. Said displacement is calculated so as to guarantee a certain degree of plastic deformation to said body, based on the nominal values of molecular and physical compositions and dimension of the bodies to be bent, considering the values taken from the bending of a plurality of bodies having the same constructive and operative characteristics.

In some applications, the prior art automatic bending systems, which impart to the free portion of the body a single angular displacement in a certain direction, are sufficient to cause in the body a deformation within the precision standards required for a desired application of the body to be bent.

Nevertheless, in cases where it is fundamental to achieve a bending or plastic deformation within very restricted precision limits, these prior art automatic bending processes do not consider as relevant parameters, during the plastic deformation of each body of a plurality of equal bodies, the deviations that normally occur in terms of dimension, microstructure and molecular composition in said bodies. This problem can be solved by a sequence of bending operations which are carried out in a cumulative manner in relation to each body to be bent, until the final desired precise result is obtained. However, in terms of industrial production as, for example, in the manufacture of reed valves for hermetic compressors used in small refrigeration systems, it is impossible to achieve a precise bending of each reed valve through a practically manual control of the sequential deformation steps applied to each reed valve.

In the presently known automatic bending systems, the angular displacement, which is applied to the free portion of the body to be bent, in order to achieve a final desired plastic deformation, is calculated considering only one body with nominal characteristics, for a plurality of bodies to be bent. Except in rare occasions, the reality is that the bodies from a plurality of bodies to be bent present certain dimensional and microstructural variations relative to each other. Thus, it is impossible to achieve an automatic homogeneous degree of plastic deformation for all bodies from said plurality of bodies, without deviating from the strict precision limits which were previously set up for said bodies when defined by the reed valves of the already mentioned hermetic compressors.

SUMMARY OF THE INVENTION

Thus, it is a general object of the present invention to provide a process for the automatic and permanent bending of deformable bodies through high speed automatic operations, in order to guarantee a high precision degree in the plastic deformation of said bodies, despite the deviations that may occur in the nominal microstructure, molecular composition and dimensions of said bodies in relation to a desired nominal value.

It is a further object of the present invention to provide an automatic bending process as cited above, which also allows to determine the degree of the angular plastic deformation of the bodies, as a function of certain dimensional parameters, which are external to said bodies and which are also variable and related to each body, so that the plastic deformation of a certain body can be achieved as a function of said dimensional parameter that is external to said body. In this circumstance, the process is directed to cases where the piece to be bent is assembled to a portion of variable dimension belonging to another piece or body, thereby avoiding the selection and grouping procedures for the pairs of dimensionally compatible pieces.

According to the invention, the process for the automatic bending of plastically deformable and elongated bodies, in order to define in said bodies two portions joined to each other about a bending line and forming an angle that is at least substantially transverse to the longitudinal axis of the body, comprises the steps of:

a— setting up, experimentally, the relation between the different degrees of angular displacement that are applied, around the bending line, to one of the longitudinal portions of bodies having the same structural characteristics as the body to be bent, and the resulting plastic deformation; and to determine the equation of the "angular displacement× plastic deformation" standard curve for the body to be bent;

b—fastening a longitudinal portion of a body to be bent to a fastening device;

c—measuring the original position of at least one point of the free body portion of the fastened body being bent in relation to a fixed point of reference and registering this initial value of relative positioning;

d—imparting to the free body portion of the body that is being bent a first angular displacement, around the bending line and in the direction of the desired plastic deformation, by an angle corresponding to the achievement of a deformation value preferably in one of the intervals between 60% and 90% of the desired plastic angular deformation, based on the equation defined in step "a";

e—measuring the new angular position of said point of the free body portion of the body being bent, and comparing it with the position of step c, in order to define the degree of plastic deformation which was obtained with the previous angular displacement that was applied to the free body portion;

f—setting up, for the degree of plastic deformation obtained in step "e", a new equation for the "angular displacement×plastic deformation" curve that is specific for that body in the respective bending phase and defining, mathematically and as a function of the new equation, an additional angular displacement to be imparted to the free portion of the body being bent in order to achieve a desired plastic deformation;

g—applying to the free portion of the body being bent another angular displacement around the same bending line, by an angle which corresponds to the angle defined in step "f";

h—submitting the body that is being bent to at least one sequence of the steps "e", "f" and "g", in order to achieve the final desired plastic deformation; and i—releasing from the fastening device the body presenting the final desired plastic deformation. The operational sequence described above includes only one second plastic-deforming angular displacement in order to achieve the bending of the body within the tolerances required for the considered application.

The steps "e", "f" and "g" can be sequentially repeated until there is achieved the desired precision for the plastic deformation of the body that is being bent.

The bending process mentioned above further allows the automatic definition of the plastic deformation degree that will be applied to the body, as a function of variable dimensional parameters of other elements to which said body will have to operatively adapt.

BRIEF DESCRIPTION OF THE DRAWINGS

The bending process in question will be described now, with reference to the attached drawings, in which.

DETAILED DESCRIPTION OF THE INVENTION

Figure 1:
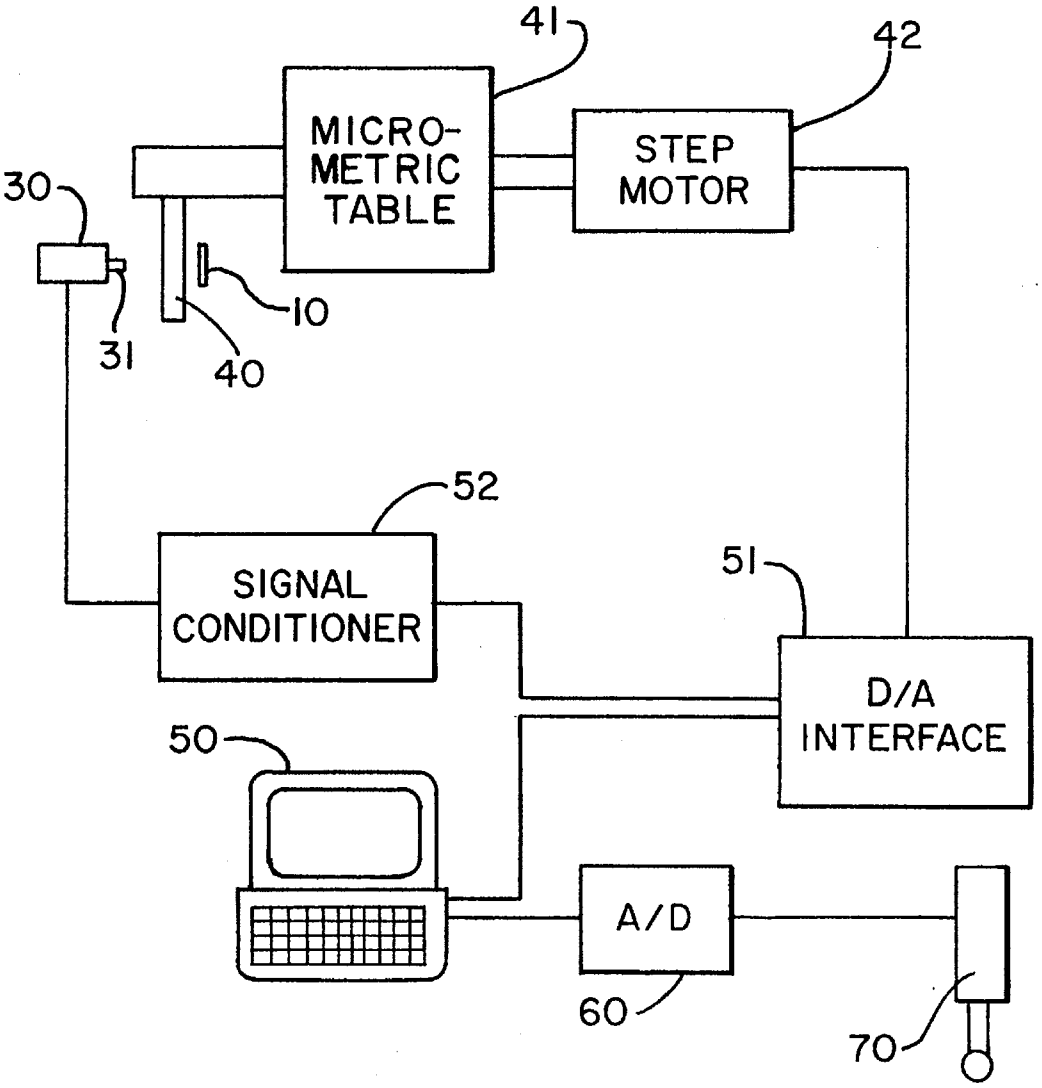
FIG. 1 shows a block diagram of a possible apparatus to carry out the bending steps mentioned above.

As already mentioned, the process object of this invention is particularly useful for the precise and automatic bending, in industrial production scale, of metallic blades employed in the manufacture of reed valves for hermetic compressors. In a more specific way, the present process allows a precise plastic deformation of the metallic blade that functions as blade impelling means for the suction and discharge valves described in patent application BR 9002967 (corresponding to U.S. Ser. No. 715,818/91) of the same applicant.

According to the attached drawings, the process is used to achieve a precise plastic deformation of a metallic blade or rod 10, through the bending of one of its end portions, around a bending line which is transverse to the longitudinal axis of the blade 10. In the present case, the blade 10 is represented by a small rod which is used as elastic impelling means for the reed valves of small hermetic compressors, as described in the above mentioned prior application.

To initiate the process, a plurality of blades 10 having the same characteristics concerning dimensions, molecular composition and microstructure as the body to be bent are experimentally bent to determine the relation between different degrees of the angular displacement which is applied around said bending line, to one of the longitudinal portions of the blades 10, and the plastic deformation that is achieved in said one portion. The term "plastic deformation" is intended to mean the amount the body is actually finally deformed in response to an amount of angular displacement of the body about a bending line.

This setup can be done through any adequate manner that allows the determination of a sampling of said "angular displacement×plastic deformation" relation for the plurality of blades 10 having the same characteristics as the bodies that are going to be bent.

This experimental procedure allows to determine the equation of an "angular displacement×plastic deformation" standard curve for the characteristics of blades 10 to be bent. An example of this type of curve is illustrated as A in FIG. 2, in which the ordinate axis represents the plastic or permanent deformation obtained in the pieces, and the abscissa axis represents the angular displacement imparted to said pieces in order to achieve such deformation. Curve A represents the desired nominal plastic or permanent deformation that is expected for the characteristics of the blade or piece that is being bent.

It should be observed that the curve or plastic deformation begins after a certain initial displacement of the ordinate axis. This axial displacement results from an initial distance $D_0$ between the blade before bending and a point of reference which is spaced away therefrom in the direction of the bending to be achieved, and also from an initial elastic (non-permanent) deformation EDe of the piece that is being bent.

After finishing the step to determine the "angular displacement×plastic deformation" standard curve A for the characteristics of the blade to be bent, the effective bending of the blade 10 takes place.

Figure 3:
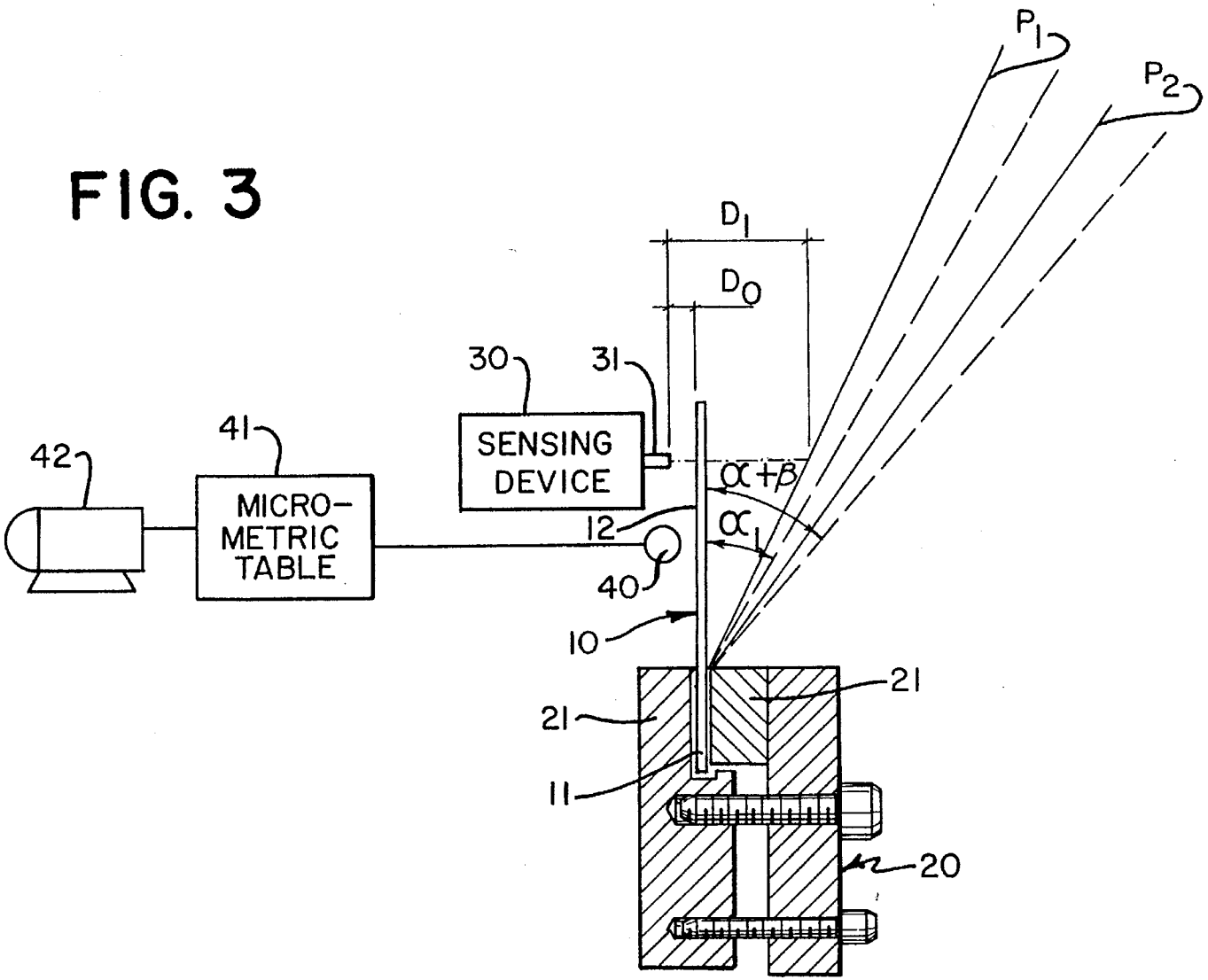
FIG. 3 shows schematic elevational front view of a possible apparatus to execute the above mentioned process.

For this purpose, each blade 10 that is going to be bent has a portion of its longitudinal extension, which is located on either side of the transverse bending line, attached to a fastening device fixture 20 which, in FIG. 3, is formed of two blocks or pads 21 made of hard metal, one of which is movable and compressible against the other through adequate means which may or may not be automatic. These two blocks 21 of the fastening device fixture 20 must be built so as to permit a correct and complete immobilization of the fixed portion 11 of the blade 10 which is being held in the fastening device fixture 20. This fixed portion 11 usually corresponds to the shortest longitudinal portion of the piece in relation to the bending line.

The positioning of each blade 10 in the fastening device 20 is preferably achieved through automatic devices which can guarantee an equal positioning for the blades 10 as the blades are being supplied to the fastening device fixture 20.

After a blade 10 has been immobilized in fastening device fixture 20, it is necessary to determine and register the original position of its free portion 12 that is going to be bent, in order to serve as a parameter for the determination of the final angular displacement that is going to be imparted to the free portion 12. One possible way to determine and register this original position of the blade 10 free portion 12 is to measure the distance along a plane which is parallel to the bending direction of the blade, between a point of reference that is fixed in relation to the fastening device fixture 20, and a point of the free portion 12 of the blade.

In FIGS. 1 and 3, there is schematically illustrated a sensing device 30, which is fixed in relation to the fastening device fixture 20 and which includes a probe 31 that can be displaced from a retracted position, corresponding to the point of reference cited above, until it touches a point of the free portion 12 of the blade 10. This probe 31 moves according to the bending direction of the blade 10, i.e., in an orthogonal plane in relation to said free portion 12. When said probe 31 touches the blade 10, it allows the sensing device to detect an information point corresponding to an initial distance $D_0$, between the fixed point of reference and the original position of the blade free portion 12.

After these initial steps, the free portion 12 of the blade 10 is submitted to an angular displacement around the bending line, which can be defined, transversely or substantially transversely, by the fastening device 20 itself, at the junction of the fixed portion 11 and the free portion 12 of the blade. The angular displacement of the free portion 12, in the bending direction to be achieved, can be obtained, for example, through a cylindrical rod 40, which is disposed parallel to the bending line and operatively associated to a micrometric table 41 (of, e.g., 0.5 mm/turn), which is driven by a step motor 42 (of, e.g., 500 steps/turn).

Figure 2:
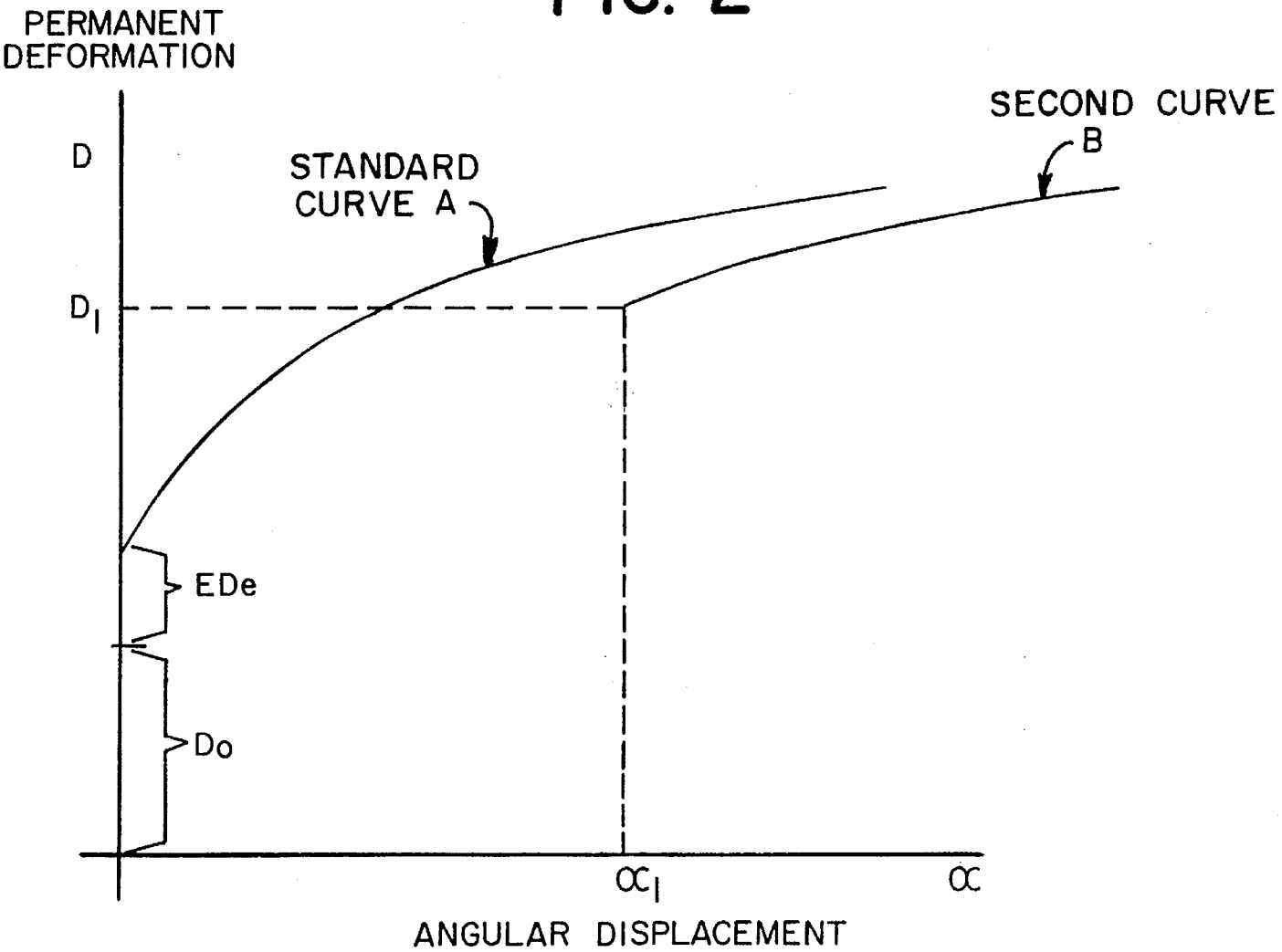
FIG. 2 shows a nominal standard "angular displacement x plastic deformation" curve of a longitudinal portion of a certain plurality of bodies in the form of metallic blades, which are used in the manufacture of reed valves for small hermetic compressors and a curve for further bending of a body.

The initial angular displacement of the free portion 12 of the blade 10 is achieved by powering the step motor 42, so that the cylindrical rod 40 engages the free portion 12 and bends it around the bending line and in the direction of the plastic deformation to be obtained, by an angle $\alpha$ which results in the achievement of a plastic deformation of 60% to 90% of the value for the final desired plastic angular deformation, taking into account the standard equation, shown in FIG. 2. Because of the resilient spring back characteristic of the blade being bent, moving it by an angular displacement results in a somewhat smaller angle $\alpha_1$ of initial plastic deformation, as shown in FIG. 2. It corresponds to the distance $D_1$ of FIG. 3.

The operational instruction to the step motor 42 is produced in a central processing unit 50, for example, the microcomputer illustrated in FIG. 1, which is accessible to the operator and instructs the step motor 42 through a digital analog interface 51 that includes specific controls for the step motor 42 operation. The computer has data corresponding to standard curve A and instructs the motor 42 to produce an amount of movement needed to obtain the desired 60%–90% of the final bend amount needed to produce the final plastic deformation.

Thus, when the angle $\alpha_1$ for the initial angular displacement of the free portion 12 of the blade 10 is reached, the cylindrical rod 40 is retracted by the table-motor assembly 41, 42 so that said free portion 12 can return to the plastic deformation first position P1 illustrated in FIG. 3.

Then, the central processing unit 50 instructs the probe 31 of the sensing device 30 to move until it touches again the now bent free portion 12 of the blade 10, so that the sensing device can send to the central processing unit 50, through a probe signal conditioner 52 and interface 51, information corresponding to the first plastic deformation D1 obtained.

The central processing unit 50 then establishes a second curve for the piece that is being bent. This second curve, which is actually a second mathematical equation produced by the computer 50, can be formed in several ways. In a preferred embodiment, the information from the standard curve A and the initial measure plastic deformation determined from the measurement $D_1$ ($\alpha_1$) is used. The second equation or curve is specific to the piece being bent. It is derived from the standard curve A of FIG. 2, shifted horizontally to the point of initial plastic deformation $\alpha_1$, and is shown as B in FIG. 2. The derivation of curve B is any selected part of standard curve A, preferably a more linear part as found more remotely from the origin. Since the standard curve A has a somewhat exponential shape, the closer the initial bend is to the final bend the better will be the result obtained in the final and/or any intermediate bend.

As an alternative, when the initial bend results in an initial angular plastic deformation close to that of the final desired plastic deformation, the second equation can have a linear profile.

The central processing unit 50 then mathematically and as a function of the new specific curve B of FIG. 2, directs a second additional angular displacement $\beta$ that is to be imparted to the free portion 12 of the blade 10. A corresponding instruction is given to the step motor 42, to cause the displacement of the cylindrical rod 40 through the micrometric table 41, in order to impart said second angular displacement $\beta$ to the free portion 12 of the blade 10, and then the cylindrical rod 40 is turned to an inoperative condition, so as to allow the free portion 12 to assume a corresponding second plastic deformation position P2 which, as a function of the first standard curve bending approach and with the corresponding correction for the specific second equation curve, is situated within the values required for the specific application. Position $P_2$ can be the required final plastic deformation.

Afterwards, the blade 10 can be released from the fastening device 20.

It should still be observed that the initial distance $D_0$, between the point of reference and the blade 10 in the original position, is defined by the sensing device 30 and registered in the central processing unit 50, in order to be subtracted from the distance $D_1$ that was measured after the first plastic annular deformation of the blade 10.

As illustrated in FIG. 1, the central processing unit 50 can be operatively connected, through an analog/digital interface 60, to another sensing device 70, which is disposed to measure, for example, the seat deepness which is specific for each blade that is bent, in order to determine the value for the plastic deformation to be imparted to each blade 10, as a function of at least one dimensional variation in a respective piece or element that is going to be associated to each particular blade.

In another embodiment, the determination of which part of the blade is going to be bent is achieved using the information received from both laminar body opposite faces. The measure obtained in the opposite face can be directly achieved by means of a plurality of sensing devices or indirectly, by reflexion, in the case of optical sensors.

The automatic activation of the fastening device for the fixation of the laminar body that is going to be deformed is carried out by a presence sensing device which reveals the existence of a piece in its surroundings, sending a signal to the central processing unit, which then initiates the bending process. In a possible embodiment, the central processing unit will begin the bending process, sending back to the fastening device an order to fasten the longitudinal portion of each laminar body opposed to the free portion of each said body.

An alternative embodiment provides a fastening device which automatically fastens the laminar body, once its presence has been detected next to said fastening device. In both cases, the liberation of the already bent pieces is automatically controlled by the central processing unit, which commands the opening of the fastening device after the bending of each impelling means has been concluded.

The actuation of the deforming device over the laminar body, which is being submitted to the bending process is related with the motion of the micrometric table 41 which carries, on its loading surface, both the deforming and the sensing devices, which are thus simultaneously forwardly moved in relation to the laminar body. In the opposite situation, in which the micrometric table carries the laminar body to be bent, said body will present a backward movement, in relation to the position sensing device and to the deforming device.

Although there has been described one embodiment of the invention, according to which there is provided only one second plastic-deforming angular displacement in the same direction as the first angular displacement, in order to achieve the final desired plastic deformation, it should be understood that the present bending process can include, besides the first displacement, a plurality of additional angular displacements having the same displacement. For each additional displacement a specific curve is produced in the same manner as curve B. That is, it can be a part of the standard curve, a part of curve B, or a linear curve, shifted from the direction of the pre-existing plastic deformation.

What is claimed is:

1. A method of permanently bending a first part of a subject deformable body having non-linear elastic characteristics to a desired angle about a bending line relative to a second part of said body comprising the steps of:

providing a plurality of said bodies having substantially the same physical characteristics as those of the subject body, generating from said plurality of bodies a first set of data of angular displacement of said first part versus resulting permanent bending about said bending line for different amounts of angular displacements of said first part, and determining from said data a first equation and standard curve of angular displacement versus plastic deformation standard curve;

fastening the second part of a subject body in a fastening device;

measuring the original position of at least one point of the free first body part of the fastened subject body in relation to a fixed point of reference and storing the initial value of measured relative positioning;

angularly displacing the first part of the subject body about the bending line by an amount determined by said first equation of angular displacement to achieve a first angle of permanent bend of said first part relative to said second part which is intentionally different from said desired angle, measuring the new angular position of said first body part of the subject body bent to said first angle relative to said measured original position to determine the degree of plastic deformation obtained by said first bend;

deriving a second equation of angular displacement versus plastic deformation for the subject body at the point of new angular position; and thereafter further angularly displacing in a predetermined direction said first part relative to the measured angle of relative positioning produced by the first named angular displacement to achieve said desired angle based upon the second equation specific for the subject body angular displacement versus plastic deformation curve.

2. A method as in claim 1 wherein said first angle is less than said desired angle and the further angular displacement is in the same direction as the bending to achieve said first angle.

3. A method as in claim 2 wherein said first angle is in the range of 60% to 90% of said desired angle.

4. A method as in claim 1 wherein the step of deriving the second equation comprises using at least a portion of the first equation standard curve shifted to the point of first angle of permanent bend.

5. A method as in claim 1 wherein the step of deriving the second equation comprises adding a predetermined function to the first equation at the point of first angle of permanent bend.

6. A method as in claim 1 further comprising the step of converting the data of said first data set to computer usable form and the step of angularly displacing said first part is controlled by said computer using such data.

7. A method as in claim 6 wherein said computer determines the difference between said first angle and said desired angle and determines the further displacement of the first part based upon the second equation.

8. A method as in claim 6 wherein the step of deriving the second equation comprises using at least a portion of the first equation shifted to the point of first angle of permanent bend.

9. A method as in claim 6 wherein the step of deriving the second equation comprises adding a predetermined function to the first equation at the point of first angle of permanent bend.

10. A method as in claim 1 wherein the step of further angular displacement of the subject body first part from the first angle is carried out in a series of sequential angular displacements of said subject body first part toward the desired angle and includes deriving a new equation at each new angle based upon the equation at the previous angle of bend.

* * * * *